US012709436B2

(12) United States Patent
Burgstaller

(10) Patent No.: US 12,709,436 B2
(45) Date of Patent: Aug. 18, 2026

(54) PLATE WITH OPENING AID FOR CANS

(71) Applicant: Peter Burgstaller, Eferding (AT)

(72) Inventor: Peter Burgstaller, Eferding (AT)

( * ) Notice: Subject to any disclaimer, the term of this patent is extended or adjusted under 35 U.S.C. 154(b) by 151 days.

(21) Appl. No.: 18/720,557

(22) PCT Filed: Dec. 12, 2022

(86) PCT No.: PCT/EP2022/085448
§ 371 (c)(1),
(2) Date: Jun. 14, 2024

(87) PCT Pub. No.: WO2023/110779
PCT Pub. Date: Jun. 22, 2023

(65) Prior Publication Data

US 2025/0058931 A1 Feb. 20, 2025

(30) Foreign Application Priority Data

Dec. 14, 2021 (AT) ..... A 60309/2021

(51) Int. Cl.
*B65D 17/28* (2006.01)

(52) U.S. Cl.
CPC .. *B65D 17/4014* (2018.01); *B65D 2517/0014* (2013.01); *B65D 2517/0041* (2013.01)

(58) Field of Classification Search
CPC ..... B65D 17/4014; B65D 2517/0014; B65D 2517/0041; B65D 17/4012
(Continued)

(56) References Cited

U.S. PATENT DOCUMENTS 3,637,104 A 1/1972 Dutnell
3,850,334 A 11/1974 Wharton
(Continued)

FOREIGN PATENT DOCUMENTS

AT 522882 B1 3/2021
DE 3931573 A1 4/1991
(Continued)

OTHER PUBLICATIONS

Espacenet English-language Abstract for DE 3931573 A1, Apr. 4, 1991.
(Continued)

*Primary Examiner* — James N Smalley
(74) *Attorney, Agent, or Firm* — Tiajoloff & Kelly LLP

(57) ABSTRACT

A metal plate (1) with an opening aid for cans has an upper and a lower face, a central (7) and a radial (8) edge, and two lateral edges (18) connecting ends of the central and radial edge. The plate is slightly curved, and the radial edge extends over a partial circle with an angle of at least 150°, wherein a receiving area (9) for the rivet is provided on the central edge. The lateral edges have edge reinforcements reinforcing the plate. The radial edge has a groove anchor (10) that forms a sliding rail that engages a groove of the beverage can. The upper face is equipped with at least one elevation (15) that engages the lever of the can and functions as an opening aid. The elevation has gradually inclines towards its ends, and runs approximately concentrically. The upper face has at least one pushing aid, preferably with a knob (20). The corners between the lateral edges and the radial edge form radially protruding corner flanges (13).

20 Claims, 4 Drawing Sheets

(58) Field of Classification Search
USPC ..... 220/254.4; 81/3.27
See application file for complete search history.

(56) References Cited

U.S. PATENT DOCUMENTS

| | | | | |
|---|---|---|---|---|
| 4,681,238 | A | 7/1987 | Sanchez | |
| 4,717,039 | A | 1/1988 | Ayyoubi | |
| 4,852,763 | A | 8/1989 | Dimberio | |
| 4,880,136 | A | 11/1989 | Englert | |
| 4,913,304 | A | 4/1990 | Corey | |
| 5,199,591 | A | 4/1993 | Thibeault et al. | |
| 5,351,853 | A | 10/1994 | Shock | |
| 5,785,199 | A | 7/1998 | Woidtke | |
| 5,996,832 | A | 12/1999 | Nieuweoudt | |
| 6,098,830 | A | 8/2000 | Jamieson | |
| 6,290,084 | B1 | 9/2001 | Louie | |
| 6,321,927 | B2 | 11/2001 | Cavella | |
| 6,386,814 | B2 | 5/2002 | Song | |
| 6,390,749 | B2 | 5/2002 | Song | |
| 6,722,518 | B1 | 4/2004 | Bartz | |
| 7,500,577 | B2 | 3/2009 | Wichelhaus | |
| 8,727,164 | B1 | 5/2014 | Majcen et al. | |
| 8,881,940 | B2 | 11/2014 | Ramsey et al. | |
| 10,118,730 | B2 | 11/2018 | Stuermer | |
| 2001/0019058 | A1 | 9/2001 | Song | |
| 2001/0022305 | A1 | 9/2001 | Cavella | |
| 2001/0040163 | A1 | 11/2001 | Song | |
| 2002/0070219 | A1 | 6/2002 | Song | |
| 2005/0211708 | A1 | 9/2005 | Thomas | |
| 2006/0070994 | A1* | 4/2006 | Tiikkainen ..... | B65D 17/4014 220/254.4 |
| 2006/0163254 | A1 | 7/2006 | Wichelhaus | |
| 2007/0131690 | A1* | 6/2007 | Gavino ..... | B65D 17/4014 220/269 |
| 2009/0001092 | A1 | 1/2009 | Jenkins | |
| 2009/0032531 | A1* | 2/2009 | Navare ..... | B65D 17/4014 220/254.1 |
| 2013/0168457 | A1 | 7/2013 | Li | |
| 2013/0270265 | A1 | 10/2013 | Ramsey et al. | |
| 2017/0008666 | A1 | 1/2017 | Stuermer | |

FOREIGN PATENT DOCUMENTS

| | | | |
|---|---|---|---|
| DE | 4427812 | A1 | 2/1996 |
| DE | 19744245 | A1 | 4/1999 |
| DE | 10018685 | C2 | 6/2001 |
| DE | 102020121789 | A1 | 3/2021 |
| EP | 0816248 | A1 | 1/1998 |
| KR | 20200109801 | A | 8/2020 |
| WO | 2010/109341 | A1 | 9/2010 |
| WO | 2015/109349 | A1 | 7/2015 |

OTHER PUBLICATIONS

Espacenet English-language Abstract for DE 4427812 A1, Feb. 1, 1996.

Espacenet English-language Abstract for DE 19744245 A1, Apr. 22, 1999.

Espacenet English-language Abstract for KR20200109801 A, Sep. 23, 2020.

* cited by examiner

PLATE WITH OPENING AID FOR CANS

FIELD OF THE INVENTION

The present invention relates to a plate with an opening aid for cans.

BACKGROUND OF THE INVENTION

The coronavirus pandemic has shown how important hygiene is, especially when it comes to smear and droplet infections. Beverage cans pass through many hands before they reach the end customer. The end customer touches parts of the can with their lips while drinking. If these parts of the can are contaminated during transportation, the end customer could become infected.

Various types of closures are known for beverage cans. They can be roughly divided into slide-, clip-, rotational- and lid-closures.

A slide-closure is characterized by the fact that a closure element is attached to the beverage tab of the beverage can in order to close the opening of the beverage can. U.S. Pat. Nos. 5,785,199, 6,098,830, 6,722,518 B1 and U.S. Pat. No. 5,351,853 disclose such slide-closures for beverage cans. In U.S. Pat. Nos. 6,098,830, 6,722,518 B1 and U.S. Pat. No. 5,351,853, the closure has rail elements that can accommodate the opening clip of the beverage can and thus stabilize the closure. By placing the opening clip of the beverage can on the closure device, the closure device itself is pressed against the can. The opening is thus closed. In U.S. Pat. No. 5,785,199, the closure is pulled through the tab of the opening clip and folded over, whereby a plate is provided which closes the opening of the beverage can.

US 2009 00 01 092 A1, U.S. Pat. Nos. 8,727,164 B1, 7,500,577 B2, 3,637,104 and 3,850,334 disclose various types of clip-closures for beverage cans. They are characterized by the fact that the opening of a beverage can is closed by a clip which is inserted into the opening of the beverage can. In US 2009 00 01 092 A1, U.S. Pat. Nos. 7,500,577 B2 and 3,850,334, the clip holds itself at the edge of the opening of the beverage can. In U.S. Pat. No. 8,727,164 B1, the closing clip is connected to the opening clip, so that reclosing is made possible by the opening clip. U.S. Pat. No. 3,637,104 discloses a hook and a closure plate, wherein the closure plate is placed in the opening and the hook is clamped to the edge of the can so that the closure plate presses against the lid of the beverage can from below and thus closes the opening.

In US 2013 016 8457 A1, EP 08 16 248 A1, WO 2010/109341 A1, U.S. Pat. No. 6,321,927 B2, 8,881,940 B2, U.S. Pat. Nos. 5,199,591, 4,913,304 4,880,136 and 5,285,924, various lid-closures for beverage cans are disclosed. They are characterized by the fact that a closure is placed on a beverage can which at least partially covers the lid of the beverage can. The opening of the beverage can is also covered.

DE 44 27 812 A1, DE 197 44 245 A1, DE 100 18 685 C2, DE 39 31 573 A1, U.S. Pat. Nos. 4,717,039 and 4,681,238 show several rotational-closures. DE 44 27 812 A1, DE 39 31 573 A1, U.S. Pat. Nos. 4,717,039 and 4,681,238 are characterized by the fact that the closure is connected to the rivet in the middle of the lid. The closure is therefore rotatable and can close the opening of the beverage can by rotating it accordingly. Due to the connection to the rivet, it is necessary to manufacture the can during production. DE 197 44 245 A1 and DE 100 18 685 C2 show two rotational closure hooks which are characterized by the fact that the closure can be pushed onto the lid so that rotation around the rivet is possible. The rivet in the center thus serves as an anchor point. The opening clip of the can prevents the rotation closure from coming off.

DE 197 44 245 A1 shows a rotational closure hook which can be pushed onto the lid to allow rotation around the rivet. US 2013 016 8457 A1 has a hook-shaped edge anchor element, which anchors the closure to the edge of the can, allowing it to be rotated.

SUMMARY OF THE INVENTION

The invention is based on the task of providing a plate for cans that is easy and inexpensive to manufacture.

Another task of the invention is that it reliably closes an opened can with low resistance simply by turning the plate.

In addition, another task of the invention is to protect the opening from germs that get onto the surface of the can during transportation and sale.

Another task of the invention is to provide a plate for cans that is environmentally friendly. One or more tasks are solved by the subject matter of the independent claim. Advantageous further embodiments and preferred embodiments form the subject matter of the subclaims.

A plate with an opening aid for cans with a lever, which is attached to the can by means of a rivet, has an upper and a lower face, a central and a radial edge and two lateral edges. The lateral edges each connect one end of the central and radial edges. The plate is slightly curved and the center of a sphere of curvature, which approximately describes the curvature, lies approximately on the longitudinal axis of the can and in the distal direction of the lower face. The radial edge extends over a partial circle with an angle of at least 150°, with a receptacle for the rivet being provided at the central edge. An edge reinforcement can be formed on each of the lateral edges to brace the plate. A groove anchor is formed on the radial edge, which forms an angled slide rail directed away from the lower face, which engages in a groove of the beverage can. At least one elongated, curved, approximately crescent-shaped elevation is formed on the upper face, which is arranged in such a way that it can engage with the lever of the can and serves as an opening aid, the elevation having a gradually decreasing inclination towards each of its ends. The elevation runs approximately concentrically to the rivet holder and is at least 5 mm long. At least one sliding aid is arranged on the upper face, which preferably has at least one knob. The corners of the lateral edges to the radial edge form a projection in the radial direction, thereby forming corner horns. The plate is made of metal.

The corner horns extend the radial edge, further bracing the plate. Nevertheless, the drinking opening remains free if the plate is positioned accordingly, even if the plate is not aligned in the perfect position.

The curvature of the plate, which can also be referred to as the bend, is described by the sphere of curvature. This sphere of curvature is formed when the plate continues to expand, following the curvature until a hollow body is formed. However, the sphere of curvature can also be an egg shape or an oval shape.

The fact that the plate is slightly curved or bent means that it is stable and fits snugly against the lid of the can, which means that little dirt gets between the plate and the lid. It has been shown that despite the large surface area of the plate, it can be moved with little effort. The curved shape adapted to the upper face of the corresponding can also contributes to this, so that there are no points on the plate that press against the upper face of the can under high tension. The slide rail preferably rests in a groove of the can in such a way that a strong frictional effect between the remaining area of the plate and the upper face of the lid is avoided.

In addition, the groove anchor is pressed into the groove by the curvature and the contact pressure transferred to the plate by the rivet.

The elevation is also referred to below as the opening aid. As it falls on both sides, the direction of rotation of the plate to open the can is irrelevant.

As the opening aid is longer and crescent-shaped compared to the opening aids of the prior art, it can also be higher in order to generate a stronger leverage effect. Due to the crescent shape, the opening aid slides easily under the lever. The length of the opening aid ensures that the inclination of the opening aid is so flat that the opening aid can be slid under the lever with little force and does not swing the lever away. The longer the opening aid is, the slower the slope is while the height remains the same. The slower the slope, the easier it is to slide the opening aid and the lever.

The groove anchor has a centering function so that the receptacle for the rivet can be given a little more clearance at the central edge. This makes the plate easier to turn. The groove anchor nestles against the groove and slides over it when the plate is rotated.

The edge reinforcement braces the plate and provides a visual aid to help one recognize where the plate starts so that one can reach for it and turn it.

Because the plate is made of metal, preferably aluminum, the plate can be made very thin. The reinforcements described above ensure that it is nevertheless rigid and does not bend when the can is turned upside down, for example. The reinforcements also minimize friction and make it easier to turn the plate.

Because the plate is made of metal, especially aluminum, it can be made from the same material as the can itself. This facilitates the recycling process and protects the environment. The plate shape makes it easy to manufacture, e.g. using punching processes in which the plates are punched out of sheets.

The plate can be rotated around the rivet. The movement of the plate is guided by the recess adjacent to the rivet. The guide on the rivet makes it easy to move.

The plate is suitable for sealing the opening of the can, e.g. to prevent insects or other dirt from entering the beverage can. Furthermore, carbonated drinks retain their taste for longer as the carbon dioxide cannot escape through the air as quickly.

When the plate is turned, the opening aid can slide under the lever of the can and lift it slightly. This makes it easier to open the can.

Due to the plate-shaped design, it does not protrude beyond the edge of the can, which means that the can remains stackable. The plate can also be arranged on a closed can during its manufacture. The shipping of cans that are grouped together in several pallets is not hindered by the arrangement of a closure on each of the cans.

Preferably, the groove anchor is formed over the entire length of the radial edge of the plate. This ensures a uniform load over the entire length of the radial edge of the plate.

The groove anchor is preferably adapted to the shape of the groove of the beverage can with regard to the circular shape of the groove as well as the cross-sectional shape of the groove. In particular, the groove anchor is designed to fit snugly against the inner boundary surface formed by the groove. In addition, the groove anchor can also be designed in such a way that it fits snugly against an outward-facing boundary surface of the groove.

The shape of the groove anchor can be adapted to the groove by bending the plate. However, the groove anchor can also be a thicker body than the rest of the plate, which extends into the groove.

Preferably, the plate has a thickness of at least 0.2 mm, at least 0.5 mm, at least 0.75 mm and at least 1 mm. With such a thickness of the plate, the plate has sufficient stability and not too much material is used, which keeps the costs low.

According to a further development, the elevation has a length of at least 7 mm, at least 10 mm and at least 20 mm.

With such a length, the elevation can easily slide under the lever of the can and still provide sufficient leverage. With shorter elevations, the rise would either be too steep so that the elevation could not slide under the lever or the elevation would not be high enough so that the leverage would be too low to provide sufficient support to open the can.

In embodiments, the elevation on each of the two sides may slope evenly over a distance of at least 1 mm, at least 3 mm and at least 5 mm.

The route described here allows the elevation to be pushed gently under the lever without having to apply too much force and the lever is still lifted far enough to be able to open the can.

Preferably, the elevations have a height of at least 0.25 mm, at least 0.5 mm and at least 1 mm and that the elevations have a maximum height of 0.25 mm, a maximum height of 0.5 mm and a maximum height of 1 mm.

With such an elevation, the leverage is sufficient for the lever to rise in such a way that a piece of a user's finger can reach under it to simply lift the lever up to open the can.

According to a further development, the radial edge is curved in such a way that it forms a partial circle with an angle of at least 200°, at least 250° and at least 300°.

With such a curvature, the plate is particularly stable and, in a corresponding position, the opening of the can is effectively closed so that no or only a few drops of the beverage leave the can even if the can is tilted or rotated.

In embodiments, the corner horns may form a projection of at least 2 mm, at least 4 mm and at least 8 mm. Corner horns with such a length extend the radial edge, which further increases the stability, yet leaves a sufficiently large area of the can surface so that the opening of the can is completely exposed when the plate has been placed in a corresponding position.

According to a further development, the lateral edges have a curvature due to the extruded corner horns and the edge reinforcement is arranged along this curvature.

Because the edge reinforcements are arranged along the curvatures, the edge reinforcements themselves are curved. Due to this curvature, the reinforcement has two directions, which stabilizes the plate in the surface, as the two directions span such a surface.

Preferably, the edge reinforcement is formed as a thickening of the material at this point and preferably has at least 1.2 times, at least 1.5 times and at least 2.0 times the other platelet thickness.

Such an edge reinforcement cover is a good compromise between sufficient bracing of the plate and material savings.

According to a further development, the sliding aid has at least 3 knobs, at least 5 knobs and at least 10 knobs.

Such a number of knobs is a good compromise between the grippability of the plate and the amount of material required for the knobs. Too large a number arrangement can also irritate the user and or dirt can get caught on the knobs. Too small a standard number does not provide enough friction surface for a user to interact with the knobs with their finger in such a way that the plate rotates.

In embodiments, the knobs of the sliding aid can be designed in the top view as a rectangle with strongly rounded corners, wherein the rectangle has an aspect ratio of at least 1:1, at least 1:2 and at least 1:4.

Knobs with this aspect ratio in the top view are stable on the one hand, so that they do not break off when interacting with a user's finger, and on the other hand they provide good haptic feedback for the user, who then recognizes the radius in which he has to turn the plate. Preferably, the lower face is coated with a plastic.

The coating is in particular polyethylene terephthalate (PET), polytetrafluoroethylene (PTFE), polypropylene (PP), polyethylene (PE), high-density polyethylene (HDPE), low-density polyethylene (LDPE) or linear low-density polyethylene (LLDPE). They are inert to most of the contents of cans, so there is no loss of flavor. Furthermore, they can reduce the friction between the closure and the beverage can, which facilitates rotation.

According to a further development, the upper face is printed.

For example, a printed surface can be designed to have features on it that integrate with a visual recognition system, for example to transport the cans using a reporter.

However, clues, motifs, logos or other items can also be placed on these plates.

A Plate with an opening aid for cans with a lever, in particular according to an embodiment described above, has an upper and a lower face, a central and a radial edge and two lateral edges, each of which connects one end of the central and radial edge. The lever is attached to the can by means of a rivet. The radial edge extends over a partial circle with an angle of at least 90°, with a receptacle for the rivet being provided on the central edge. A slide rail is formed on the radial edge in such a way that it engages in a groove of the beverage can. At least one elongated, approximately crescent-shaped elevation is formed on the upper face, which is arranged in such a way that it can engage with the lever of the can and serves as an opening aid, the elevation having a gradually decreasing inclination towards each of its ends. At least one sliding aid is formed on the upper face. The plate is formed in one piece from metal and shaped by embossing.

The elevation is also referred to below as the opening aid. As its inclination decreases on both sides, the direction of rotation of the plate to open the can is irrelevant.

As the opening aid is longer and crescent-shaped compared to the opening aids of the prior art, it can also be higher in order to generate a stronger leverage effect. Due to the crescent shape, the opening aid slides easily under the lever. The length of the opening aid ensures that the inclination of the opening aid is so flat that the opening aid can be slid under the lever with little force and does not swing the lever away. The longer the opening aid is, the slower the slope is while the height remains the same. The slower the slope, the easier it is to slide the opening aid and the lever.

The slide rail has a centering function so that the receptacle for the rivet can be given a little more clearance at the central edge. This makes the plate easier to turn. The slide rail fits snugly against the groove and slides over it when the plate is turned.

Because the plate is made of metal, preferably aluminum, the plate can be made very thin. The reinforcements described above ensure that it is still rigid and does not bend when the can is turned upside down, for example. The reinforcements also minimize friction and make it easier to turn the plate.

Because the plate is made of metal, especially aluminum, it can be made from the same material as the can itself. This facilitates the recycling process and protects the environment.

The plate is formed in one piece, which means it does not have to be assembled first, and shaped by embossing. This means that a single step is required in production if a cut-out blank is already available. This reduces production costs and it is easy to produce many plates in a short time.

During embossing, a forming tool is applied to a metal blank, preferably aluminum, with high pressure. The high pressure causes the blank to deform. This deformation is a relief and forms the plate.

The plate can be rotated around the rivet. The movement of the plate is guided by the recess adjacent to the rivet. The guide on the rivet makes it easy to move.

The plate is suitable for sealing the opening of the can, e.g. to prevent insects or other dirt from entering the beverage can. Furthermore, carbonated drinks retain their taste for longer as the carbon dioxide cannot escape through the air so quickly.

When the plate is turned, the opening aid can slide under the lever of the can and lift it slightly. This makes it easier to open the can.

Due to the plate-shaped design, it does not protrude beyond the edge of the can, which means that the can remains stackable. The plate can also be arranged on a closed can during its manufacture. The shipping of cans that are combined in several pallets is not hindered by the arrangement of a closure on each of the cans.

A can system comprises a can and a plate with a can opening aid as described above, wherein the plate with a can opening aid is attached to the can.

A method for manufacturing a can system described above is characterized in that first the can is manufactured, then the plate is placed on the groove and then the lever is placed on the groove and in the last step the groove is closed.

BRIEF DESCRIPTION OF THE DRAWINGS

The invention is explained in more detail below with reference to the drawing.

DETAILED DESCRIPTION

Figure 1:
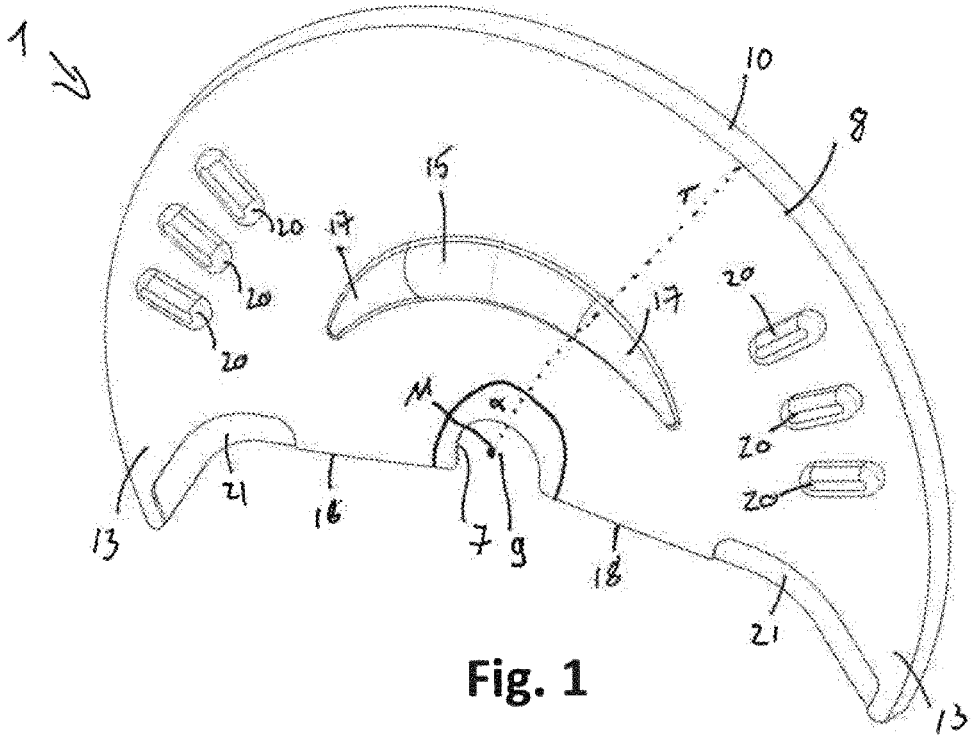
FIG. 1 schematically shows an embodiment of a plate in angled top view.
Figure 2:
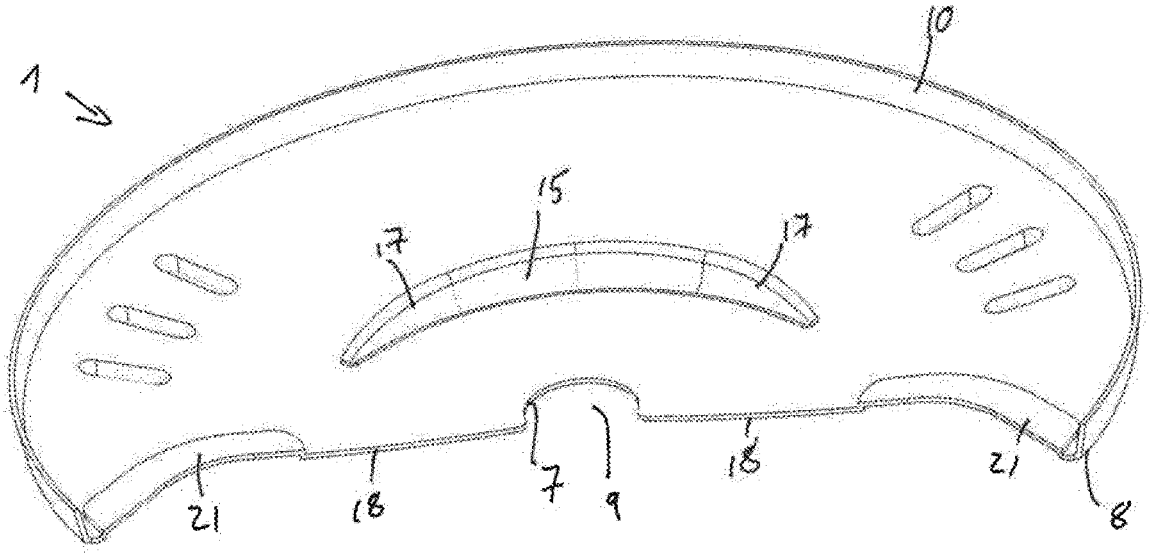
FIG. 2 schematically shows the same embodiment of a plate in angled bottom view, FIG. 3 schematically shows the same embodiment of a plate in flat top view, FIG. 4 schematically shows the same embodiment of a plate in side view, FIG. 5 schematically shows a top view of the same embodiment of a plate, and FIG. **6*a-h*** each schematically show an embodiment of a plate and a beverage can in side view.

A plate 1 for a can 2, in particular a beverage can, is described below (FIGS. 1-6).

The can 2 has a substantially cylindrical shape. One side of the cylinder, referred to as the head plate 22, has an opening 3 of the beverage can 2. A rivet 4 is arranged next to the opening 3, to which a lever 11 is attached, which is designed to press in a part of the lid of the can 2. A pressed-in lid part 12 is then located inside the can 2. A rivet head 14 is formed at the end of the rivet. The rivet head 14 is a flat, mostly round plate, which is arranged at the end of the rivet 4 and has a larger radius than the rivet 4, the rivet head 4 prevents the lever 11 from loosening inadvertently. At the edge, the beverage can 2 has a groove 5 and a raised edge 6.

The plate 1 has a central edge 7, a radial edge 8 and 2 lateral edges 18.

The plate 1 has corner horns 13, which form a projection in the radial direction at the corners of the lateral edges 18, towards the radial edge 8.

The plate has an edge reinforcement 21, which is formed at the lateral edges 18 and braces the plate.

The plate 1 has a slight curvature and the center of a sphere of curvature, which describes the curvature, lies approximately on the longitudinal axis of the can and is arranged distally to the lower face of the plate 1.

In the top view, the plate 1 has approximately the shape of a sector of a circle with a radius r and a center angle $\alpha$ around a circle center M (FIG. 1). The shape of the plate is such that the center angle $\alpha$ is approximately 200°.

In this embodiment example, the plate 1 is designed as a protective cover 1 and is also referred to as such in the following.

The center of the circle M is located at a central edge 7 of the protective cover 1 and is arranged in such a way that it is congruent with the center of the rivet 4 of the beverage can 2 when the protective cover 1 is arranged on the beverage can 2.

In the top view, the central edge 7 forms a circular segment-shaped recess 9 for the receptacle of the rivet 4. The indentation 9 is in the shape of a segment circle. The radius of the circular segment-shaped recess corresponds at least to the radius of the rivet 4.

Another possibility, not shown here, is that the indentation 9 is completely enclosed by the metal of the plate 1.

In the top view, the protective cover 1 is only as large as is sensible for the function of the closure and is necessary to cover the opening 3 of the beverage can 2 and provide sufficient stability. The protective cover 1 is a mass-produced article. The smaller it is, the cheaper it is to manufacture.

The radius r of the sector of the circle essentially corresponds to the usual distance between the rivet 4 and the groove 5 of the beverage can 2.

The radius r of the sector of the circle is smaller than the usual distance between the rivet 4 and the raised edge 6 of the beverage can 2.

The protective cover has an opening aid 15. The opening aid 15 is an elevation pointing upwards, away from the can. It is formed at approximately half the distance from the central edge 7 to the radial edge 8 of the closure.

Figure 3:
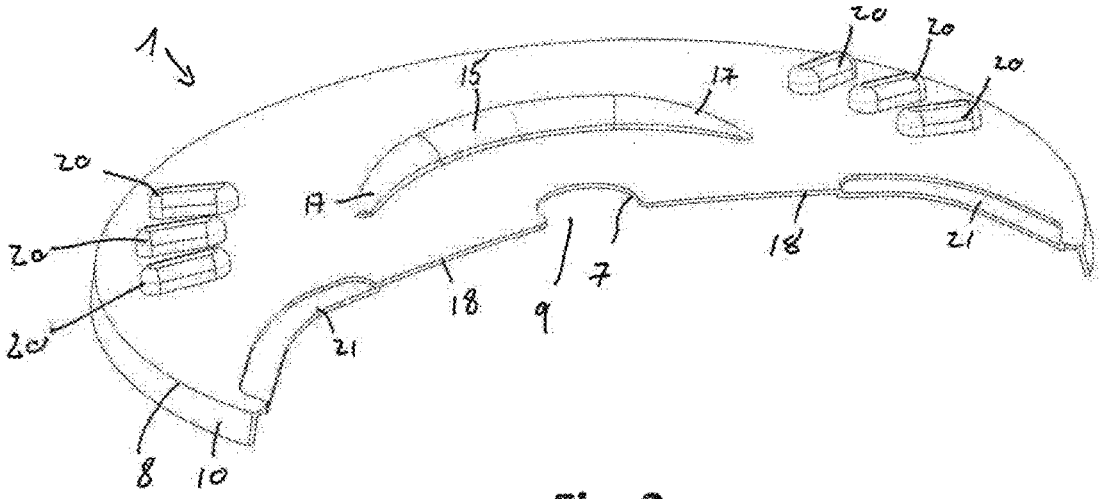
Figure 4:
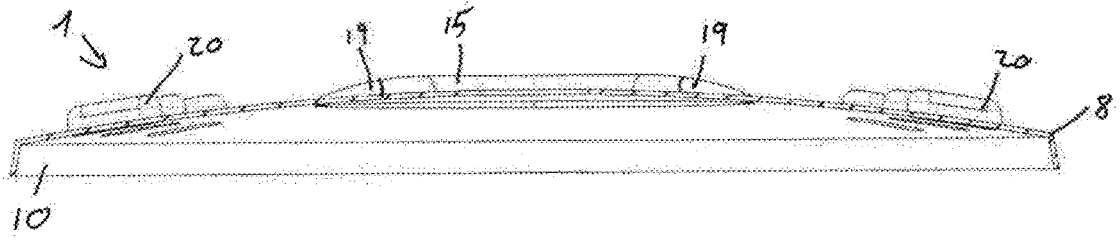
Figure 5:
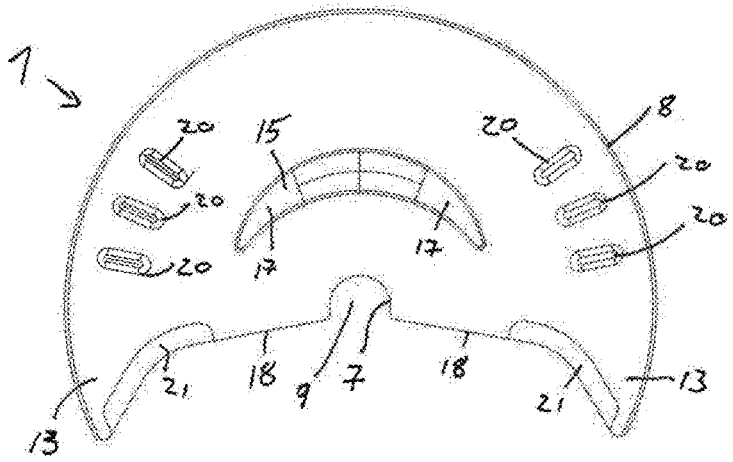

The opening aid 15 is designed as an elevation which, as in the embodiments explained above, has two edges 17, each of which runs approximately in a tangential direction, i.e. approximately parallel to the radial edge 8. As a result, the opening aid 15 is slightly curved and is crescent-shaped. Each edge 17 of the opening aid 15 has a substantially uniform inclination, which descends from the center of the opening aid in the direction towards the lateral edge 18 until the edge 17 has reached the level of the surface of the plate 1. The angle 19 that the edge 17 makes with the surface of the plate 1 is preferably at least 3°, in particular at least 5° and particularly preferably at least 8° (FIG. 3). The maximum angle 19 is less than 30° and preferably less than 20°. Due to the gradual slope of the edge 17, the opening aid 15 can be slid under the lever 11 of the can 2 with little effort, whereby the lever 11 is lifted upwards by the opening aid 15. The opening aid 15 spreads like a wedge between the surface of the can 2 and the lever 11.

In principle, other geometries of the opening aid 15 are also conceivable. Provided they have at least one slanted side that is transverse to the radial direction of the beverage can 2.

In this embodiment example, the opening aid 15 is punched.

Figure 6A:
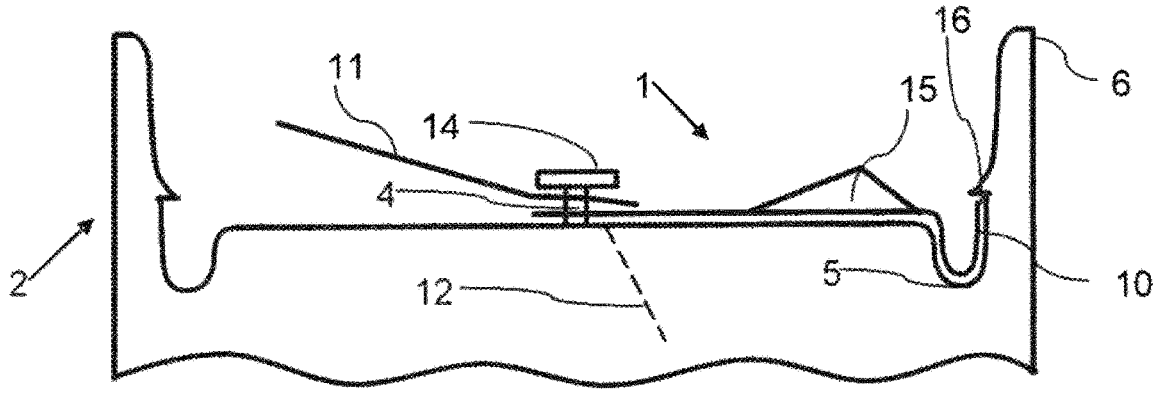
Figure 6B:
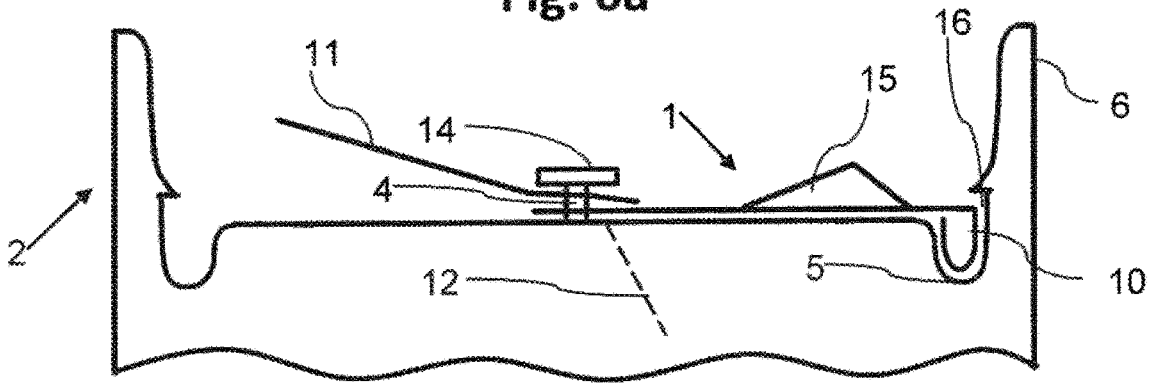
Figure 6C:
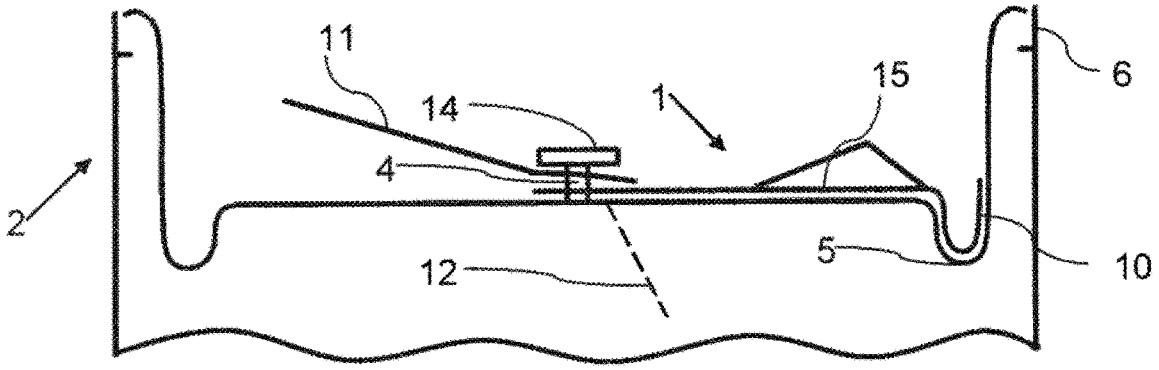
Figure 6D:
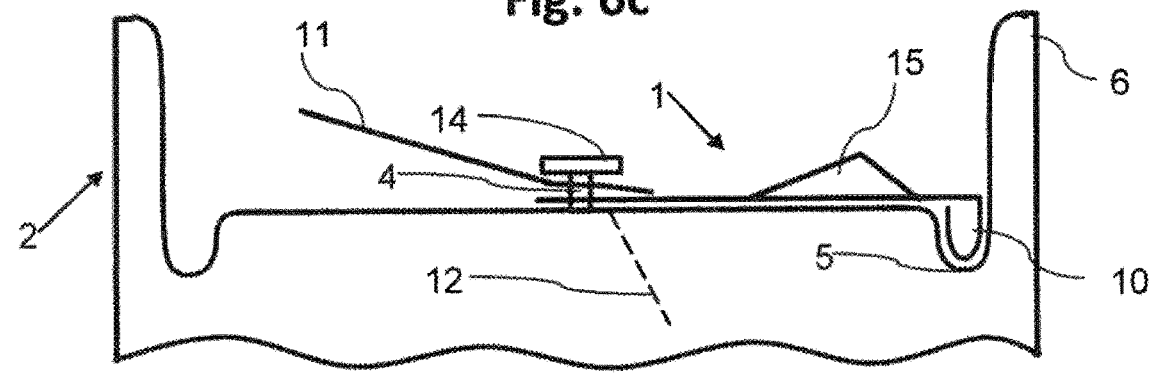
Figure 6E:
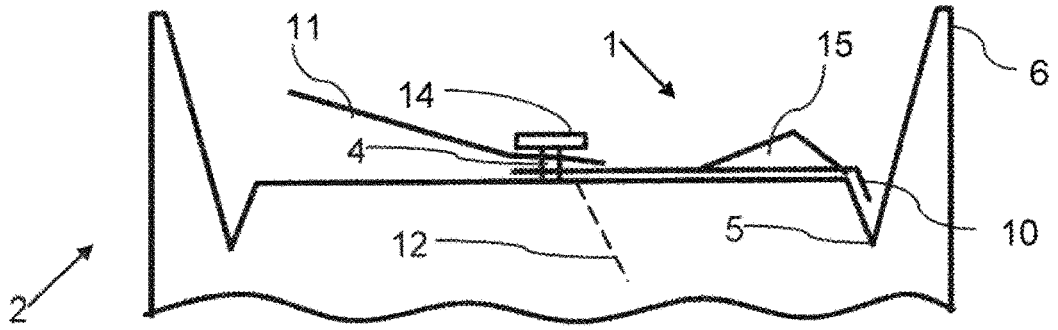
Figure 6F:
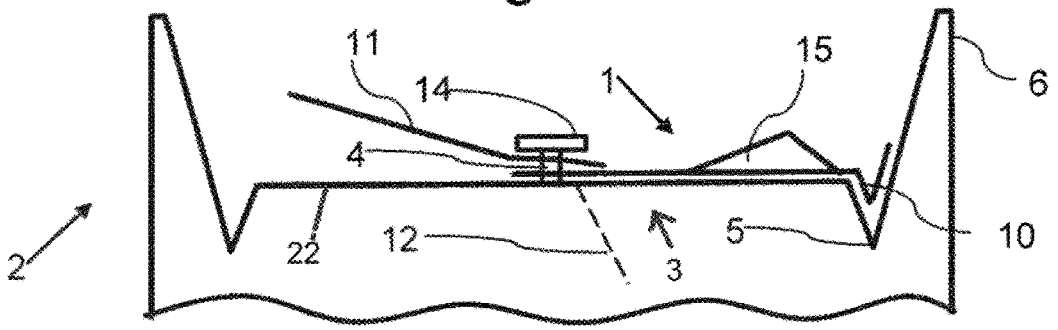

The protective cover 1 is formed at the radial edge 8 with a groove anchor 10, which can engage in the groove 5. In this embodiment example, this groove anchor 10 is formed by a bend in the radial edge 8, whereby the radial edge 8 is bent downwards in such a way that it engages in the groove 5 of the beverage can 2 (FIGS. 1-5, FIGS. 6*e*, 6*h*). The width of the bent section corresponds approximately to the depth of the groove 5. Alternatively, the radial edge 8 can also be bent twice and form a V-shape when viewed from the side. The groove anchor 10 here also has a projection extending towards the raised edge 6 (FIG. 6*f*).

Figure 6G:
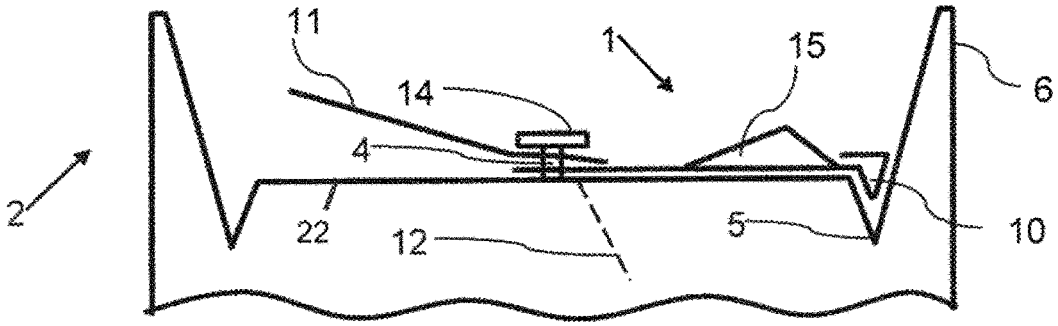
Figure 6H:
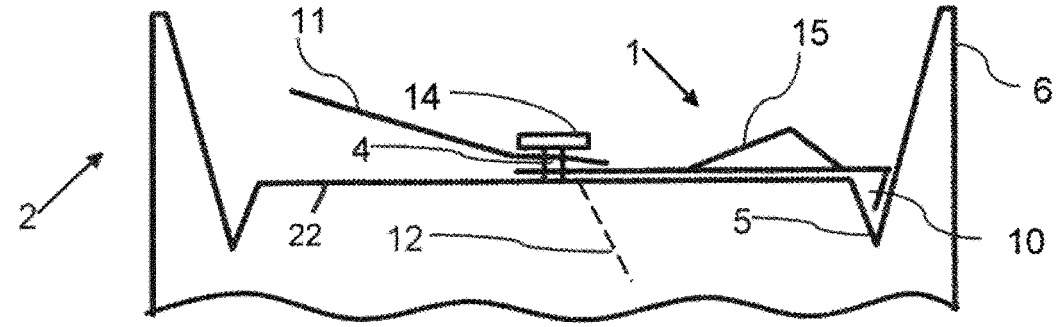

Another possibility is that the groove anchor 10 is bent three times (FIG. 6*g*). Compared to the previous alternative, the groove anchor 10 here also has a projection pointing in the direction of the central edge 7 (FIG. 6*a*).

The groove anchor 10 can also alternatively adapt to the shape of the groove 5 (FIG. 6*a*-6*d* to 3*d*).

One possibility is that the groove anchor 10 protrudes from the lower face of the protective cover 1 due to additional material. In the side view, the protective cover 1 has a thickening at this point. This can be made of the same material as the rest of the protective cover 1 or of a different material.

The plate 1 has a grip area 20, which is arranged on the adjacent other lateral edge 18 (FIGS. 1-5). In the present embodiment example, this gripping area is formed by a number of slightly upwardly protruding, embossed knobs. These thus form a corrugated surface, so that a displacement torque can be easily transmitted to the plate 1 at the grip area with a finger in order to rotate it and slide it under the lever 11 with the opening aid 15.

The grip area can also be formed by another type of roughening, such as by sandblasting this section. The grip area is preferably much less raised than the opening aid 15, which makes it possible to insert the plate 1 under a lever in such a way that the grip area is first slid through under the lever until the plate 1 is arranged such that the lever is located in the area between the grip area 20 and the opening aid 15.

A method for manufacturing a can system described above is characterized in that first the can is manufactured, then the plate is placed on the groove and then the lever is placed on the groove and in the last step the groove is closed.

The opening aid 15 can also be wedge-shaped. In an alternative embodiment, the knobs 20 are punched into the plate as negative knobs.

Another possibility is that the knobs 20 correspond to a structure, for example a letter or a number or a sign in Braille.

REFERENCE SIGNS

1 Protective cover/plate
2 Can
3 Opening of the beverage can
4 Rivet
5 Groove

6 Raised edge
7 Central edge
8 Radial edge
9 Indentation
10 Groove anchor
11 Lever
12 Pressed-in cover part
13 corner horn
14 Rivet head
15 Opening aid
16 Can projection
17 Edge of the opening aid
18 Lateral edge
19 Angle
20 Knobs
21 Edge reinforcement
22 Top plate
r Radius
α Center point angle
M Center of circle

The invention claimed is:

1. A plate structure with an opening aid for a can having a lever that is attached to the can with a rivet, said plate structure comprising:

a plate having an upper face and a lower face, a central edge and a radial edge, and two lateral edges that each connect a respective end of the central edge and a respective end of the radial edge, wherein the radial edge of the plate is curved with a curvature approximating a sphere of curvature having a curvature center that lies approximately on a longitudinal axis of the can and downward from the lower face, wherein the radial edge extends over a partial circle with an angle of at least 150°, wherein the central edge provides a receptacle configured to receive the rivet, each of the lateral edges having a respective edge reinforcement thereon, wherein the edge reinforcements brace the plate, and the radial edge has a groove anchor thereon, wherein the groove anchor forms an angled slide rail that is directed away from the lower face and engages in a groove of the can, the upper face having at least one elongate, substantially crescent-shaped upwardly projecting elevation thereon, wherein the elevation is configured to engage with the lever of the can and serves as the opening aid, wherein the elevation has ends and a decreasing inclination towards each of the ends thereof, the elevation extending generally concentrically to the receptacle and being at least 5 mm long, and at least one sliding aid is arranged on the upper face, wherein the sliding aid has at least one knob, wherein the lateral edges have corners that each form a respective projection in a radial direction towards the radial edge and form corner horns, and wherein the plate is made of metal.

2. The plate structure according to claim 1, wherein the plate has a thickness of at least 0.2 mm.

3. The plate structure according to claim 1, wherein the elevation has a length of at least 7 mm.

4. The plate structure according to claim 1, wherein the elevation has two sides that slope evenly over a distance of at least 1 mm.

5. The plate structure according to claim 1, wherein the elevation has a height of at least 0.25 mm.

6. The plate structure according to claim 1, wherein the radial edge is curved so as to form a partial circle with an angle of at least 200° about the longitudinal axis of the can.

7. The plate structure according to claim 1, wherein the corner horns are extruded at least 2 mm.

8. The plate structure according to claim 1, wherein the lateral edges have a curved portion due to the corner horns, and the edge reinforcement is arranged along said curved portion.

9. The plate structure according to claim 1, wherein the edge reinforcement is formed as a thickening of the plate, and the thickening is at least 1.2 times a thickness of the plate away from the thickening of the edge reinforcement.

10. The plate structure according to claim 1, wherein the at least one sliding aid has at least 3 knobs.

11. The plate structure according to claim 10, wherein the knobs of the sliding aid are each configured as a rectangle with rounded corners, the rectangle having an aspect ratio of at least 1:1.

12. The plate structure according to claim 1, wherein the plate has an underside that is coated with a plastic.

13. The plate structure according to claim 1, wherein the upper face is configured to receive printing thereon.

14. The plate structure according to claim 1, wherein at least one pushing aid is formed on the upper face, and the plate is formed in one piece and shaped by embossing.

15. A can system comprising the plate structure according to claim 1, and a beverage can to which the plate structure is attached.

16. A method for producing a can system according to claim 15, said method comprising first providing the beverage can, then placing the plate structure on a groove of the beverage can, and then placing a lever on the groove of the beverage can, and closing the groove.

17. The plate structure according to claim 1, wherein the plate has a thickness of at least 1 mm.

18. The plate structure according to claim 1, wherein the elevation has a length of at least 20 mm.

19. The plate structure according to claim 1, wherein the elevation has two sides that slope evenly over a distance of at least 5 mm.

20. The plate structure according to claim 1, wherein the elevation has a height of at most 1 mm.

* * * * *